US006655499B2

(12) United States Patent
Metheney, Jr.

(10) Patent No.: US 6,655,499 B2
(45) Date of Patent: Dec. 2, 2003

(54) WASHER AND TAMPER-EVIDENT CAP FOR OIL PLUG

(76) Inventor: William D. Metheney, Jr., 217 State St., Grove City, PA (US) 16127

( * ) Notice: Subject to any disclaimer, the term of this patent is extended or adjusted under 35 U.S.C. 154(b) by 149 days.

(21) Appl. No.: 10/302,408

(22) Filed: Nov. 16, 2001

(65) Prior Publication Data

US 2003/0116382 A1 Jun. 26, 2003

(51) Int. Cl.[7] ..... B65D 33/16; F16C 3/14
(52) U.S. Cl. ..... 184/1.5; 184/88.1; 184/90
(58) Field of Search ..... 184/1.5, 88.1, 184/88.2, 89, 90; 215/251, 306; 220/257.1, 257.2, 276, 375; 222/153.06, 153.1

(56) References Cited

U.S. PATENT DOCUMENTS 1,633,420 A * 6/1927 Schlayer ..... 220/324
1,645,982 A * 10/1927 Bishop ..... 384/401
1,923,767 A * 8/1933 Weldon ..... 184/90
4,075,099 A * 2/1978 Pelton et al. ..... 210/168
5,048,578 A * 9/1991 Dorf et al. ..... 141/346
5,327,862 A * 7/1994 Bedi ..... 123/196 R
5,411,114 A * 5/1995 Bedi et al. ..... 184/1.5
5,522,475 A * 6/1996 Thompson ..... 184/1.5
5,593,054 A * 1/1997 Glynn ..... 215/225
5,653,353 A * 8/1997 Otto et al. ..... 215/306
5,743,358 A * 4/1998 Bedi et al. ..... 184/1.5
5,908,086 A * 6/1999 Conklin et al. ..... 184/1.5
5,921,213 A * 7/1999 Grigorian et al. ..... 123/196 A
5,975,157 A * 11/1999 Ashford ..... 141/98
6,000,848 A * 12/1999 Massioui ..... 383/80
6,145,688 A * 11/2000 Smith ..... 220/259.3
6,286,626 B1 * 9/2001 Evans ..... 184/1.5

* cited by examiner

*Primary Examiner*—Chong H. Kim
(74) *Attorney, Agent, or Firm*—Richard K. Thomson

(57) ABSTRACT

A sealing device for securing an oil plug in threaded engagement with the oil pan to prevent inadvertent loss of lubricating oil therefrom. The sealing device includes an elastomeric washer that underlies the bolt head of the oil plug, a partially closed-ended cylindrical sleeve that surrounds and is integral with the washer, and a cap that is interconnected to the sleeve by a membrane. The sleeve has a protruding lip extending about its upper periphery that interlocks with an abutment extending inwardly from an upper peripheral portion of the cap. Once engaged, the cap prevents the oil plug from being tampered with and from inadvertently dropping out.

9 Claims, 1 Drawing Sheet

WASHER AND TAMPER-EVIDENT CAP FOR OIL PLUG

BACKGROUND AND SUMMARY OF THE INVENTION

The present invention is directed to a device to prevent oil from "inadvertently" draining from the oil pan. More particularly, the present invention is directed to a combined sealing washer and a tamper evident cap for enclosing the drain plug.

Following an oil change, a vehicle's drain plug will occasionally not be fully seated and will vibrate loose, resulting in the oil draining out of the crank case (or oil pan) and the engine overheating, seizing or otherwise being severely damaged. A recent scam being employed by some unscrupulous persons is to take a "clunker" to a local outlet of a nationwide chain of service centers, having the oil changed, intentionally backing the plug out a few rotations, knowing that after a few hundred miles, the plug will work its way out of threaded engagement in the oil pan. The oil "inadvertently" drains out, resulting in a blown engine that is then replaced by the nationwide chain to avoid the bad publicity of a dissatisfied customer. This results in a significant cost to the service center which necessarily is passed on to the consumer in the form of increased costs of service.

The present invention is designed to keep the oil plug in threaded engagement with the oil pan and to prevent anyone from backing the plug out to perpetrate such a fraud on a service center. The sealing device is comprised of a elastomeric washer that seats under the head of the bolt serving as the oil plug; a cylindrical sleeve extending up from the washer and integral therewith, the cylindrical sleeve having securement means adjacent an upper edge thereof, a tamper-resistant, tamper-evident cap attachable to the cylindrical sleeve by said securement means, the cap surrounding the head portion of the oil plug preventing access thereto, attempted removal of the cap resulting in damage to said apparatus which makes such an attempt apparent; whereby the sealing device prevents loosening of the oil plug until it is intentionally removed. The device further comprises a membrane extending between the washer and the cap whereby said apparatus forms a single integral unit. The integral unit is preferably made of a single elastomeric material such as polypropylene. The device includes a thin-walled region of at least one of the cylindrical wall and the cap whereby attempted removal of the apparatus will result in the apparatus being rendered unusable. It will be impossible to loosen the bolt and reengage the cap to make it appear as if the installer was at fault. Further, the device is sized such that when the cap is secure, even were the oil plug to loosen, it would nonetheless remain in threaded engagement with the oil pan. In on embodiment, even if the cap is pried off, the washer will remain in sealing engagement beneath the bolt head maintaining the oil plug fully seated until it is intentionally removed to permit the oil to be drained. In a second embodiment, the prying off of the cap results in the cap being torn so that the oil cap cannot be reengaged. This prevents the oil plug from being tampered with and the cap reinstalled to make it appear that an error was made by the professional at the service center. In addition, these weakened areas of the cylindrical wall and the cap facilitate removal prior to a subsequent oil change.

Various other features, advantages and characteristics of the present invention will become apparent after a reading of the following specification.

BRIEF DESCRIPTION OF THE DRAWINGS

The preferred embodiment(s) of the present invention are set forth in the drawings, like items bearing like reference numerals and in which.

DETAILED DESCRIPTION OF THE PREFERRED EMBODIMENT(S)

Figure 1:
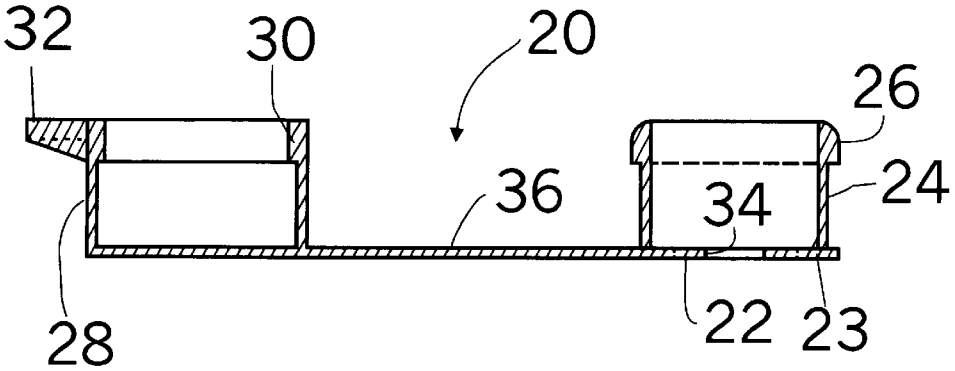
FIG. 1 is a cross-sectional side view of a first embodiment of the tamper-evident cap of the present invention.
Figure 2B:
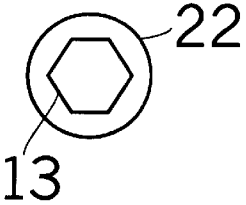
FIG. 2B is top view showing the washer secured beneath the oil plug after tampering.
Figure 2A:
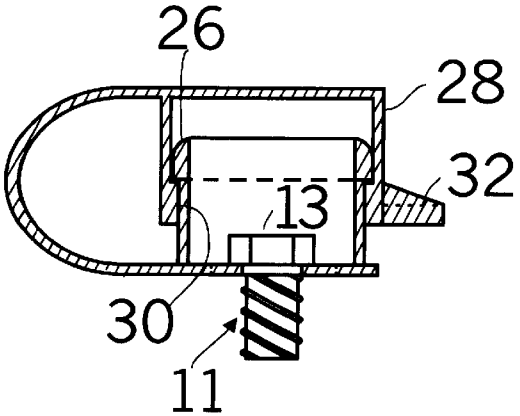
FIG. 2A is an inverted side view of the first embodiment shown installed with parts broken away for clarity.

A first embodiment of the sealing device for an oil plug 11 is shown in FIGS. 1 and 2A generally at 20. Sealing device 20 includes elastomeric washer 22 which is seated under the head 13 of oil plug 11 against the oil pan (not shown). Elastomeric washer 22 will be compressed when bolt 11 is properly seated such that it will inhibit loosening of the bolt 11 as any conventional washer would.

A partially closed-ended cylindrical sleeve 24 surrounds washer 22, extends upwardly there from and is formed integrally therewith, with the washer 22 and partially closed end of sleeve 24 defining floor 23. Securement means is formed as a protruding lip 26 around the upper periphery of sleeve 24. Cap 28 has a inwardly extending abutment 30 which engages over lip 26 to secure the cap 28 to the cylindrical sleeve and an outwardly extending flange 32. Cap 28 is designed to be tamper-resistant and tamper-evident such that any effort to remove cap 28 will result in the sealing device 20 becoming detached and rendered incapable of reuse.

In the first embodiment (FIGS. 1, 2A and 2B), this is accomplished by weakening a portion of the floor 23 between washer 22 and cylindrical sleeve 24. In use, bolt 11 is secured through opening 34 in washer 22 into the oil pan (not shown). Abutment 30 of cap 28 is flexed outwardly over lip 26 by bending interconnecting membrane 36 into a U-shape (FIG. 2A). Once abutment 30 is engaged under lip 26, the tamper-evident cap 20 may not be reopened until it is time to remove it. When removal of sealing device 20 is desired, a screw driver, or the like, is used to pry upwardly on outwardly extending flange 32. This will cause weakened portion of floor 23 to break away leaving washer 22 seated under bolt head 13 until oil plug 11 is removed. As will be apparent, even should someone attempt to prematurely remove sealing device 20, washer 22 will retain oil plug 11 secured in the oil pan (FIG. 2B) until it is intentionally removed eliminating the problem of the oil plug 11 vibrating out of the oil pan.

Figure 3:
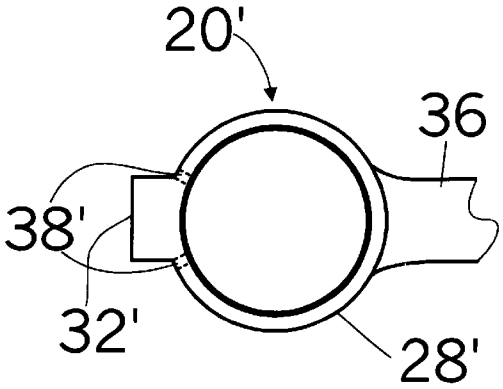
FIG. 3 is a top view of the sealing cap of a second embodiment of the tamper-evident cap of the present invention.
Figure 4:
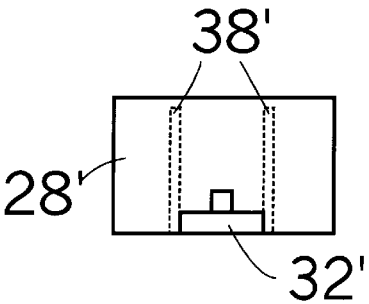
FIG. 4 is a front view of the sealing cap of the second embodiment of the tamper-evident cap of the present invention.

A second embodiment of the sealing device of the present invention is shown in FIGS. 3 and 4 generally at 20'. In this embodiment, two portions of cap 28' on either side of flange 32' are weakened as by thinning the wall, as at 38'. Since regions 38' are thinned, when a screw driver is used to pry upwardly on flange 32', cap 28' will tear at these points. This facilitates removal of sealing device 20' for a subsequent oil change and makes evident any attempt to open cap 28' to tamper with bolt 11. In addition, washer 22 remains engaged beneath bolt head 13 avoiding loosening of the oil plug 11.

The present invention provides a sealing device 20, 20' which secures a oil plug 11 against inadvertent loosening by provision of a elastomeric washer 22 beneath the bolt head 13. A cylindrical sleeve 24 surrounds the bolt head 13 and, once abutment 32, 32' on cap 28, 28' is engaged beneath lip 26 atop sleeve 24, bolt 11 is secured from tampering. Any attempt to gain access to bolt 11 will be made evident either by the tearing of the weakened area of floor 23 or by the tearing of weakened areas 38'. Sealing device 20, 20' will significantly reduce or eliminate the costly repairs associated with "inadvertent" loss of lubricating oil from the engine resulting from oil plug 11 vibrating loose.

Various changes, alternatives and modifications will become apparent to one of ordinary skill in the art after a reading of the foregoing specification. It is intended that all such changes, alternatives and modifications as fall within the scope of the appended claims be considered part of the present invention.

I claim:

1. A sealing device for use in securing an oil plug comprising a) an elastomeric washer seated beneath a head portion of the oil plug to resist undesired loosening of the oil plug;

b) a cylindrical sleeve extending up from said washer and integral therewith, said cylindrical sleeve having securement means adjacent an upper edge thereof;

c) a tamper-resistant, tamper-evident cap attachable to said cylindrical sleeve by said securement means, said cap surrounding the head portion of the oil plug preventing access thereto, attempted removal of said cap resulting in damage to said apparatus which makes such an attempt apparent;

whereby said apparatus prevents loosening of the oil plug until it is removed.

2. The sealing device of claim 1 further comprising a membrane extending between said washer and said cap whereby said apparatus forms a single integral unit.

3. The sealing device of claim 2 wherein said integral unit is made of a single elastomeric material.

4. The sealing device of claim 3 wherein said single elastomeric material is preferably polypropylene.

5. The sealing device of claim 1 further comprising an outwardly extending flange integral with said cap for facilitating removal of said sealing device.

6. The sealing device of claim 1 further comprising a thin-walled region of at least one of said cylindrical sleeve and said cap whereby attempted removal of said apparatus will result in said apparatus being rendered unusable.

7. The sealing device of claim 5 wherein said cylindrical sleeve has a partially closed end, said partially closed end thereof sharing a floor region with said washer.

8. The sealing device of claim 6 where said thin-walled region is between said elastomeric washer and said partially closed end of said cylindrical sleeve.

9. The sealing device of claim 6 wherein said thin-walled region comprises two areas in said cap on either side of said outwardly extending flange.

* * * * *